United States Patent [19]

Koltz

[11] 4,373,730

[45] Feb. 15, 1983

[54] MULTI PANEL VISUAL DEVICE

[76] Inventor: Irving M. Koltz, 1329 Steeles Ave W. TH #4, Willowdale, Ontario, Canada, M2R3N2

[21] Appl. No.: 207,393

[22] Filed: Nov. 17, 1980

[51] Int. Cl.[3] ..... A63F 9/08

[52] U.S. Cl. ..... 273/155; 434/96

[58] Field of Search ..... 273/155, 157 A; 46/35, 46/36, 37; 40/492; 434/87, 96, 427

[56] References Cited

U.S. PATENT DOCUMENTS

| | | | |
|---|---|---|---|
| 856,196 | 6/1907 | Lehman | 273/155 |
| 942,536 | 12/1909 | Bartsch | 273/155 |
| 1,125,423 | 1/1915 | Wiley | 273/157 A UX |
| 4,205,849 | 6/1980 | Perkins | 273/155 |

*Primary Examiner*—Anton O. Oechsle

*Attorney, Agent, or Firm*—Sheldon H. Parker

[57] ABSTRACT

A novelty or educational device having, in combination, a first panel having a group of illustration segments in a predetermined pattern, with at least one overlay panel contiguous to the first panel and separated from that panel by a fold line. The overlay panel has a plurality of window areas arranged in a pattern corresponding to the predetermined pattern of the first panel. A second group of illustration segments on the non-window areas, would be the complement of the first group of illustration segments and would correspond to the second overlay panel. The window areas are formed in a complex pattern alternating from window to solid area in both the horizontal and vertical directions thereby obfuscating the illustrations. Both the reverse and the obverse of each panel contains illustrations segments which are the complement of illustration segments of other panels, thereby providing a number of illustrations.

15 Claims, 16 Drawing Figures

MULTI PANEL VISUAL DEVICE

BACKGROUND OF THE INVENTION

1. Field of the Invention

The invention relates to an amusement device, toy or teaching device and more particularly to a device which includes at least one windowed member having a portion of an illustration on its surface and a graphic illustration member having a plurality of mixed illustration segments, which cooperate when the window member is overlayed on the graphic illustration member to reveal a unitary illustration.

2. Brief Description of the Prior Art

The use of venetian blind type of devices for alternately hiding or revealing a picture is well known in the field of children's books or amusement devices. However, these devices have found acceptance predominately with the very young because of the lack of intellectual challenge that they are capable of offering.

SUMMARY OF THE INVENTION

It has now been found that the intellectual challenge offered by a device which incorporates a plurality of independent illustration segments in a predetermined intermixed array of complementary overlays to produce a unitary illustration can be dramatically increased.

In accordance with the present invention, a device is provided having an illustration panel and at least one overlay panel. The illustration panel segments include a group of segments of an illustration in a predetermined pattern. The overlay panel contains an additional group of segments of illustrations in the complement to the aforenoted predetermined pattern and openings in non-illustration regions, corresponding to said aforementioned predetermined pattern. Thus, in combination, the overlay panel and the illustration panel reveal a complete illustration. A plurality of complementary overlays can be employed in combination with an illustration panel to produce a unitary picture. The illustration panel can include intermixed groups of segments of a plurality of different illustrations arranged such that different overlays produce different illustrations. The interpertation of an illustration group of segments on an overlay or an illustration panel is rendered significantly more difficult by an obfuscation technique which involves using complex patterns for the openings in the overlay panels, corresponding to the patterns of the illustration segments.

BRIEF DESCRIPTION OF THE DRAWINGS

The objects and advantages of the instant invention will become apparent when the specification is read in conjunction with the drawings, wherein.

DESCRIPTION OF THE PREFERRED EMBODIMENTS

The devices of the instant invention can vary in complexity and design, depending upon the desired end use. In its simplest form these devices have incorporated a control panel having two illustrations intermixed in horizontal segments. An illustrated right panel has horizontal, elongated rectangular windows which, in combination with the illustration panel reveal a first picture by covering one group of horizontal illustration segments and exposing the other group of horizontal illustration segments. The left panel functions in the same manner to reveal an alternate illustration. The right and left panels do not function in combination with each other since each panel contains half of an illustration in horizontal segments while the illustration panel contains the remainder of the two different illustration halves in horizontal segments. It is extremely easy to visualize or anticipate the entire illustration of this embodiment without bothering to place the overlay on the illustration panel since the horizontal combination cause little confusion to the eye.

Obfuscation can be achieved by utilizing a plurality of independent illustration segments in combination.

In one form, a plurality of overlays can be required to be placed in either a random any pattern or in a predetermined sequence to reveal a unitary illustration.

In another form, the windows can be provided in a pattern which is complex, non-uniform or otherwise confusing to the eye.

In still another form, a plurality of overlays is employed in a particular sequence such that a cover-overlay hides or covers a portion of a under-overlay. The hidden or covered portion of the under-overlay can contain patterns, designs or illustration segments which do not form a part of the final unitary illustration and thus can be used to obfuscate the portion of the illustration segments contained on the under-overlay. Similarly, regions of the illustration panel which are covered and hidden by the overlays can contain image obfuscating patterns.

Figure 1:
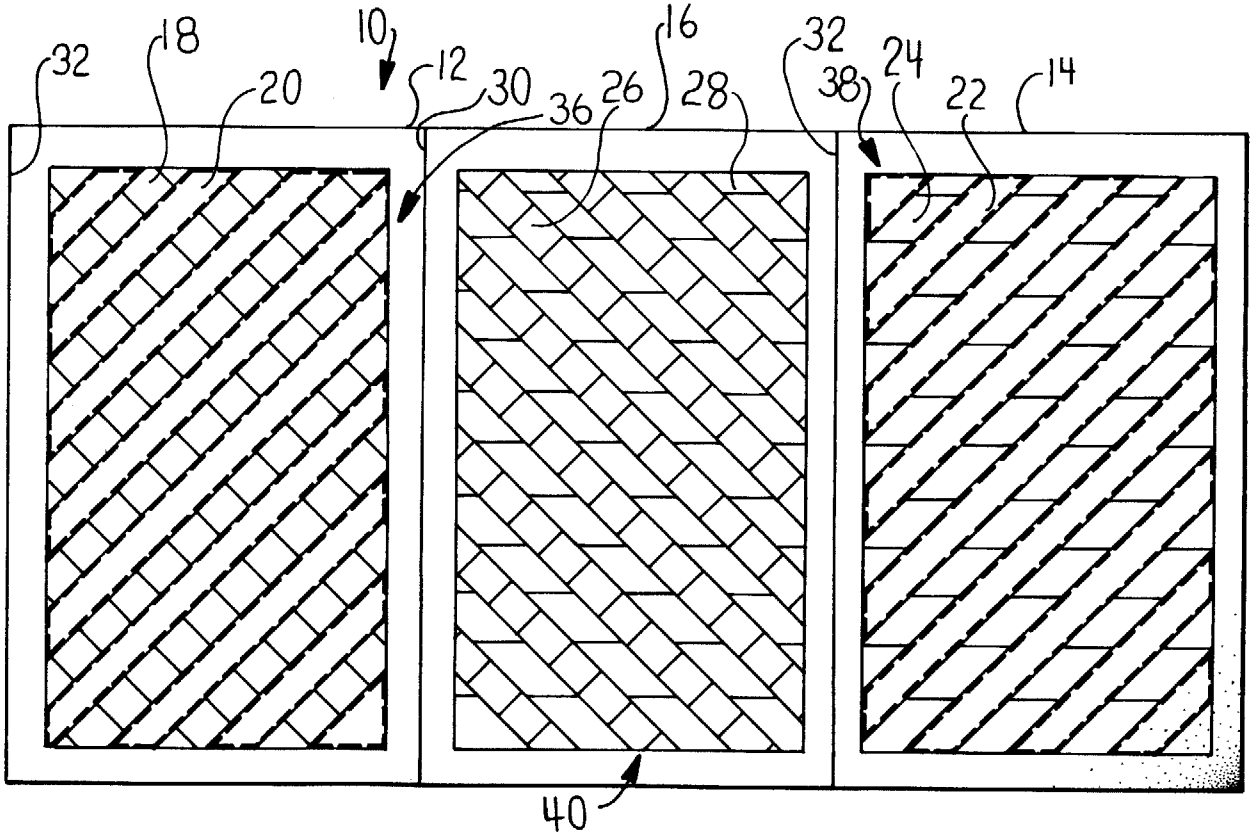
FIG. 1 is a plan view of the multi-panel card of the instant invention.

FIG. 1 illustrates a multi-panel card in accordance with the instant invention in an open or unfolded position. The card 10 is divided into three sections or panels, 12, 14 and 16, which can be folded at fold lines 30 and 32. For simplicity in the description herein, panel 14 will be referred to as the left overlay, 16 the center panel and 12 the right overlay. It should be noted, however, that the pictures can be on both sides of the card and that reference to right and left sides is not intended to limit the scope of the invention.

The left overlay 14, panel 16 and right overlay 12 are provided with a border area 34 of a predetermined consistent distance. Within each border area is a print or illustration area 36, 38, and 40. On both the right overlay 12 and the left overlay 14, the print areas 36 and 38 respectively, are provided with a pattern of alternating picture areas or segments, 24 and 18 respectively, and cut out areas or windows, 20 and 22 respectively. The use of a plurality of narrow diagonal windows 20 and 22 restricts the clear recognition or anticipation of the possible picture. The right overlay 12 and the left overlay 14 have opposite or reversed cutout areas and picture areas, thus providing for two different picture combinations when combined with the center panel 16.

Center panel 16 has alternating picture areas 26 and 28 for picture I and picture II respectively. The cutout areas 22 of overlay 14 correspond with the picture I in the area 26 of the center panel 16 and the cutout areas 20 of the right overlay 12, correspond with the picture II in the areas 28 of the center panel 16. Thus, when either the left overlay 14 or the right overlay 12 is folded at the corresponding fold lines 30 or 32, a completed picture will be formed by the complementing picture segments 18 and 26 or 24 and 28.

It must be noted at this time, however, that the amusement card 10 is generally printed on both sides, giving a total of four available pictures. Since only the obverse side can be shown in FIG. 1, it should be understood that the printing of the picture segments on the right overlay 12 and the left overlay 14 which correspond to picture segments on the center panel 16 illustrated in FIG. 1 must actually be on the opposite side from that which is shown. Therefore, when the card is folded at the fold lines 30 and 38, it is the reverse, back or opposite side as shown in this Figure, which corresponds to the center panel 16 picture.

Figure 2:
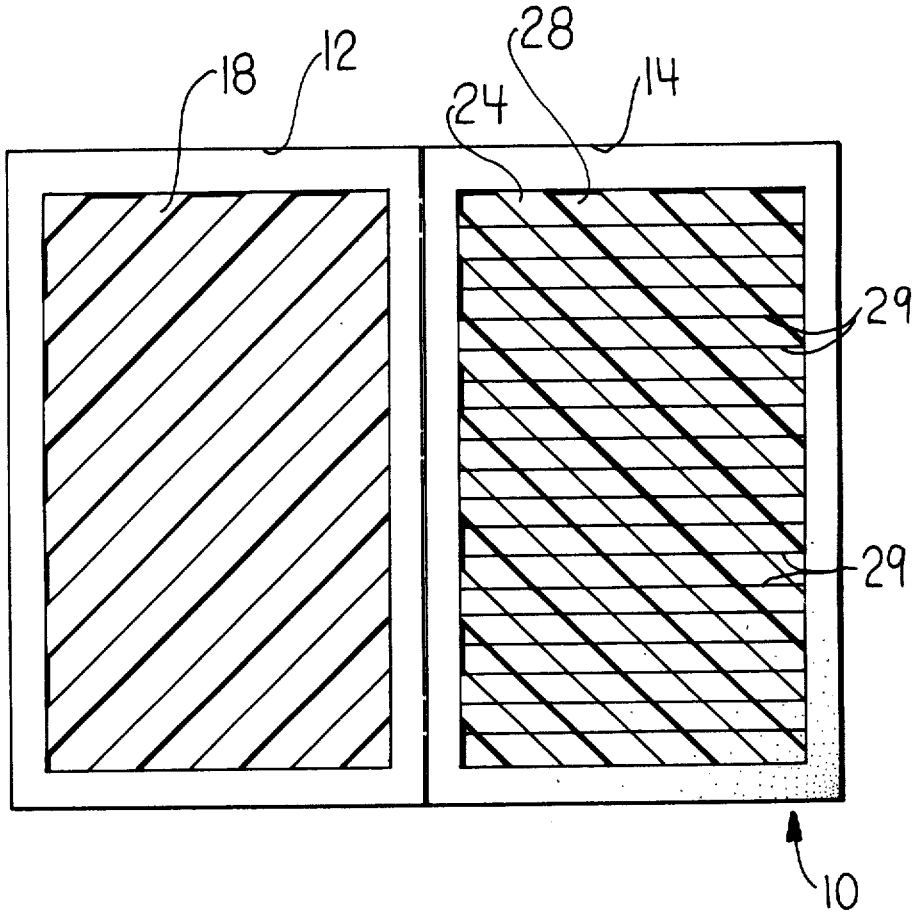
FIG. 2 is a plan view of the card of FIG. 1, partially folded.

FIG. 2 shows the overlay 14 folded over the center panel 16, revealing a completed illustration represented by the series of horizontal lines 29, half of which are on the overlay 14 and half of which are on the central panel 16.

A wide variety of window and illustration segment patterns can be employed. At the low end of simplicity is wide, uniform, parallel rectangular windows in a vertical or horizontal array. Offsetting the major axis of the window from the direction of the border or edge of the panel by about from 30° to 60° increases the confusion to the eye to the minimum degree desired, by significantly decreasing the ability to orient the illustration segment.

Additional window patterns which can advantageously be employed include:

1. arcs of one or more concentric or non-concentric circles;
2. non-parallel series as for example in a rainbow pattern;
3. free formed series of similar or dissimilar shapes;
4. varying pattern of geometric design;
5. spaced parallel rectangular opening, no greater than about ⅛ of an inch in width.

The patterns employed in the following Figures are examples of the type can be employed, but are not intended to limit the variations on the following or the scope of the invention.

Figure 3:
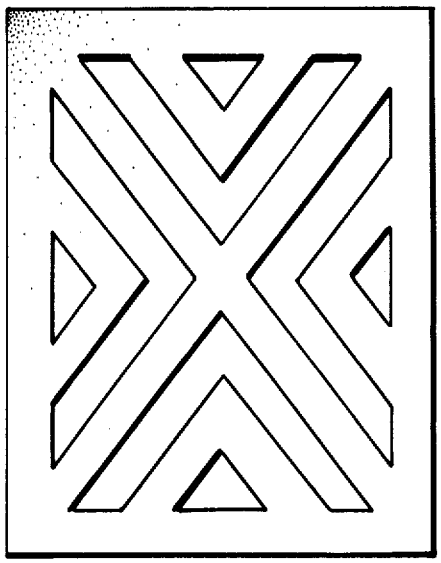
FIG. 3 is a proposed design for the card of the instant invention.
Figure 4:
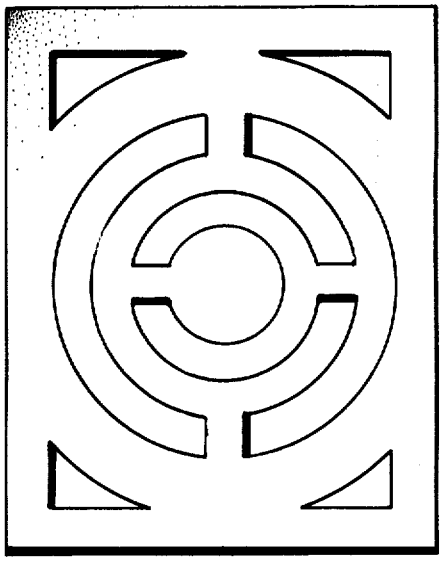
FIG. 4 is an alternate design for the card of the instant invention.
Figure 6:
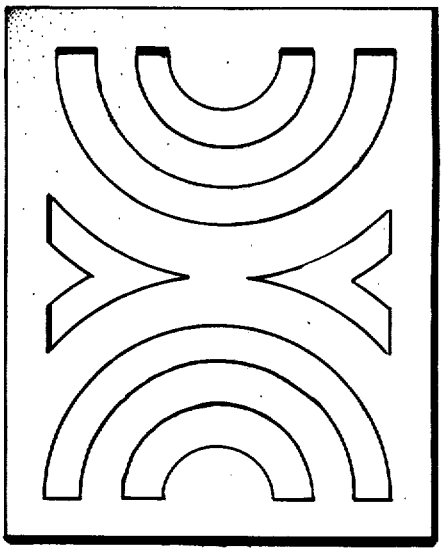
FIG. 6 is an additional design for the card of the instant invention.
Figure 7:
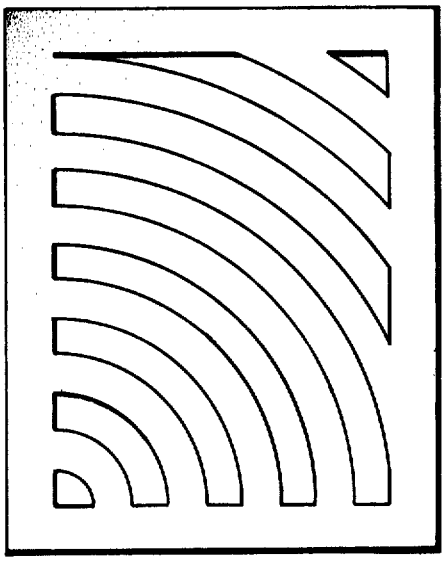
FIG. 7 is another additional design for the card of the instant invention.

FIG. 3 is a series of geometric V shapes and triangles, facing toward the center. FIG. 4 utilizes the circle within a circle, while FIG. 6 combines the half circles within each other. FIGS. 5, 8 and 10 utilize again the geometric patterns in different variations. FIG. 7 illustrates the aforenoted rainbow pattern while FIG. 9 incorporates the simpler form of diagonal rectangular sections. As is obvious from the above, the more complex the pattern, the more difficulty in determining the picture prior to placing the overlays onto the center panel.

As well known in the stencil art, modified graphics are required, as for example in the case of the letters such as A,B,D,O,P,Q,R,a,b,d,e,g,o,p and q, where one or more tab sections are required to carry the central or island portions of the letter.

The double or reverse overlay is analogous to stencils in that one overlay is formed by cutting away that which is the solid region in the other overlay. The embodiments of FIGS. 3 through 10 all provide functional reverse overlays. The term reverse overlay as used herein is intended to refer to configurations such as illustrated in these figures in which solid and window areas can be completely reversed.

While the varying patterns cannot readily be described in simple terms, the critical factor is one of discontinuity. When the eye is scanning horizontally or vertically, a picture segment contained on a panel sheet or overlay, there must be sufficient discontinuity to confuse the eye and produce the desired obfuscation. When a picture is considered in manner similar to the formation of a television picture, the picture can be considered to be formed of a plurality of horizontal or vertical lines. When a picture in accordance with the present invention is broken down into individual or component segments or lines, each line must have a plurality of alternate solid and window areas. At least two alternations per inch is preferred, resulting in an average width of about one quarter of an inch for each solid and each window region based on at least two solid and two window regions per inch. Accordingly, each picture overlay should be capable of being broken down into at least four lines or bands per inch, each band having two window and two solid areas per inch and each band being no greater than about one quarter of an inch. Preferably, this degree of alternation should be present in both the horizontal and vertical.

Figure 8:
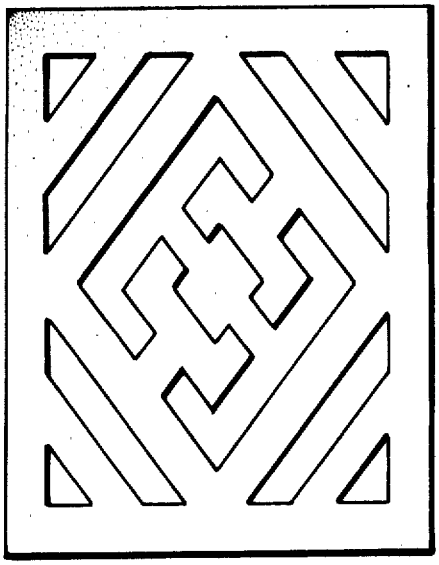
FIG. 8 is another alternate design for the card of the instant invention.
Figure 9:
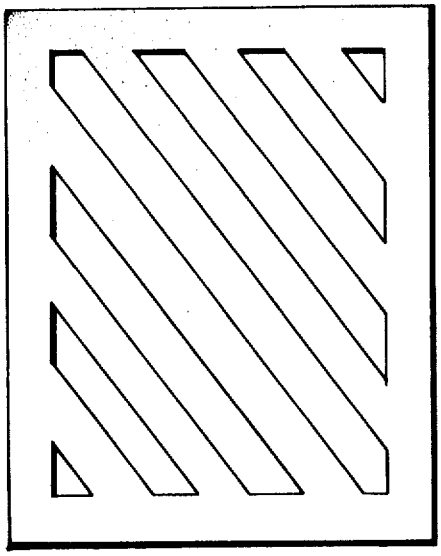
FIG. 9 is another alternate design for the card of the instant invention.

In the modification of FIG. 9, the aforenoted degree of alternation of solid and window areas can be achieved not only in the horizontal and vertical directions, but also most diagonal directions. FIG. 7 illustrates an embodiment having less uniformity and consequently greater obfuscation than the embodiment of FIG. 9, since no straight lines are used. The embodiment of FIG. 10 illustrates a pattern having the desired alternation in one of the horizontal or vertical direction while FIG. 8 illustrates both horizontal and vertical alternations at the desired level.

Figure 5:
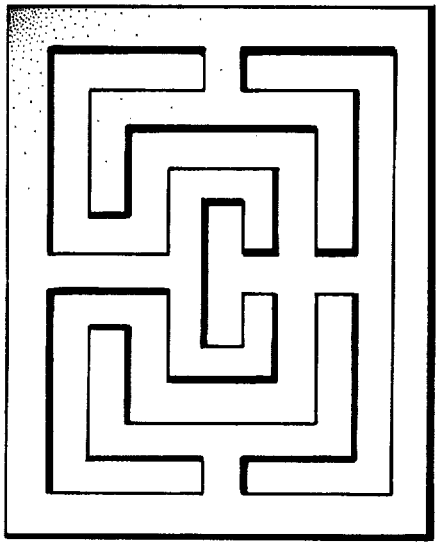
FIG. 5 is another alternate design for the card of the instant invention.
Figure 10:
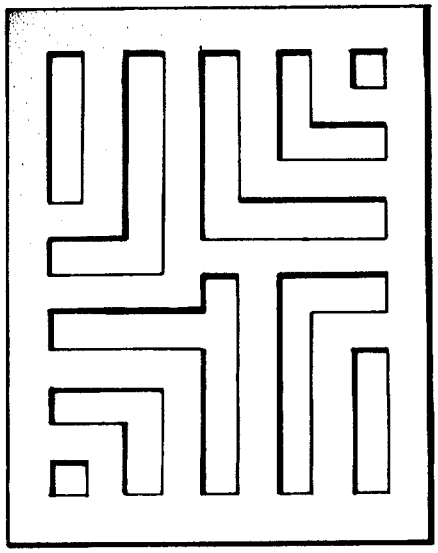
FIG. 10 is still another alternate design for the card of the instant invention.

The pattern of FIG. 5 is similar to that of FIG. 10, except that it provides fewer pattern alternations.

Figure 11:
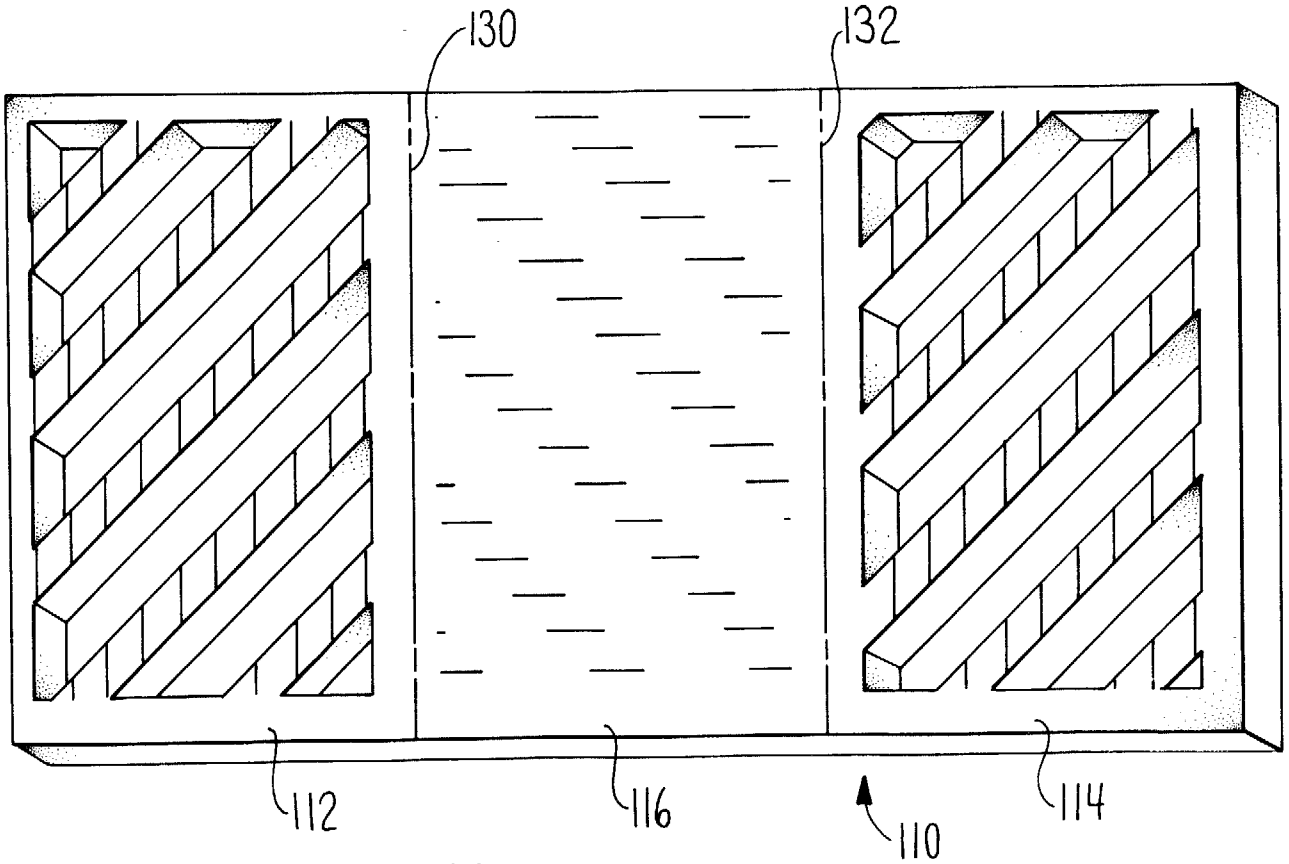
FIG. 11 is an alternate embodiment of the card of the instant invention.
Figure 13:
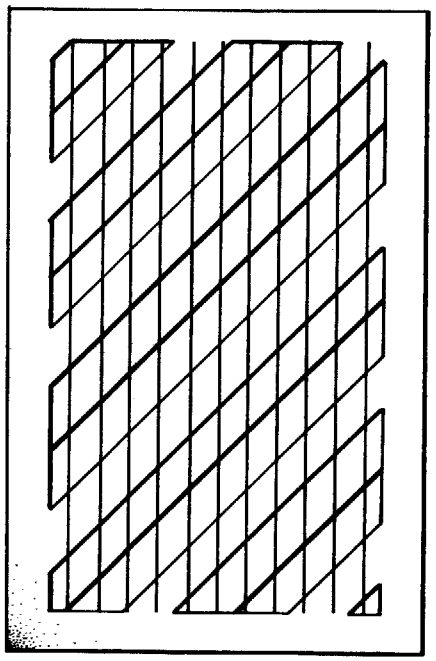
FIG. 13 shows the embodiment of FIG. 11 folded in an alternate version.
Figure 12:
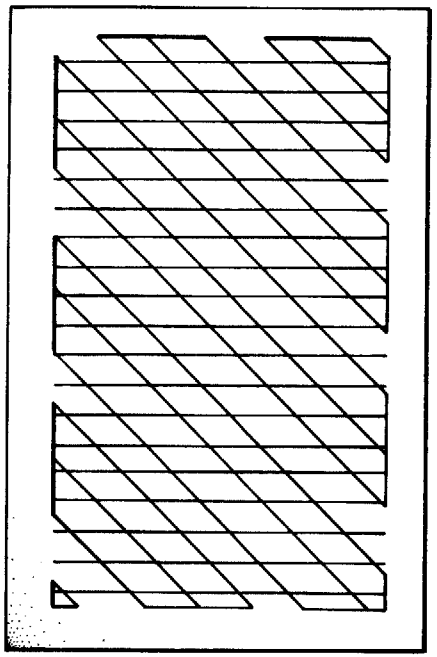
FIG. 12 illustrates the embodiment of FIG. 11 completely folded.

FIG. 11 illustrates a device 110 in which two side panels 112 and 114 are folded over at fold lines 130 and 132 respectively, in order to produce an illustration as shown in FIG. 12 are alternatively as shown in FIG. 13.

FIG. 12 shows the side panels 112 and 114 folded over the obverse side of center panel 116 to reveal a unitary illustration, one third of which is contained on the reverse side of the side panel 112, one third of which is contained on the center panel 116 and one third of which is contained on the other side panel 114. The reverse folding of the two side panels produces an article as illustrated in FIG. 13, in which the obverse sides of the side panels 112 and 114 coordinate with the complementary illustration on the reverse side of the central panel to produce a unitary illustration.

Figure 14:
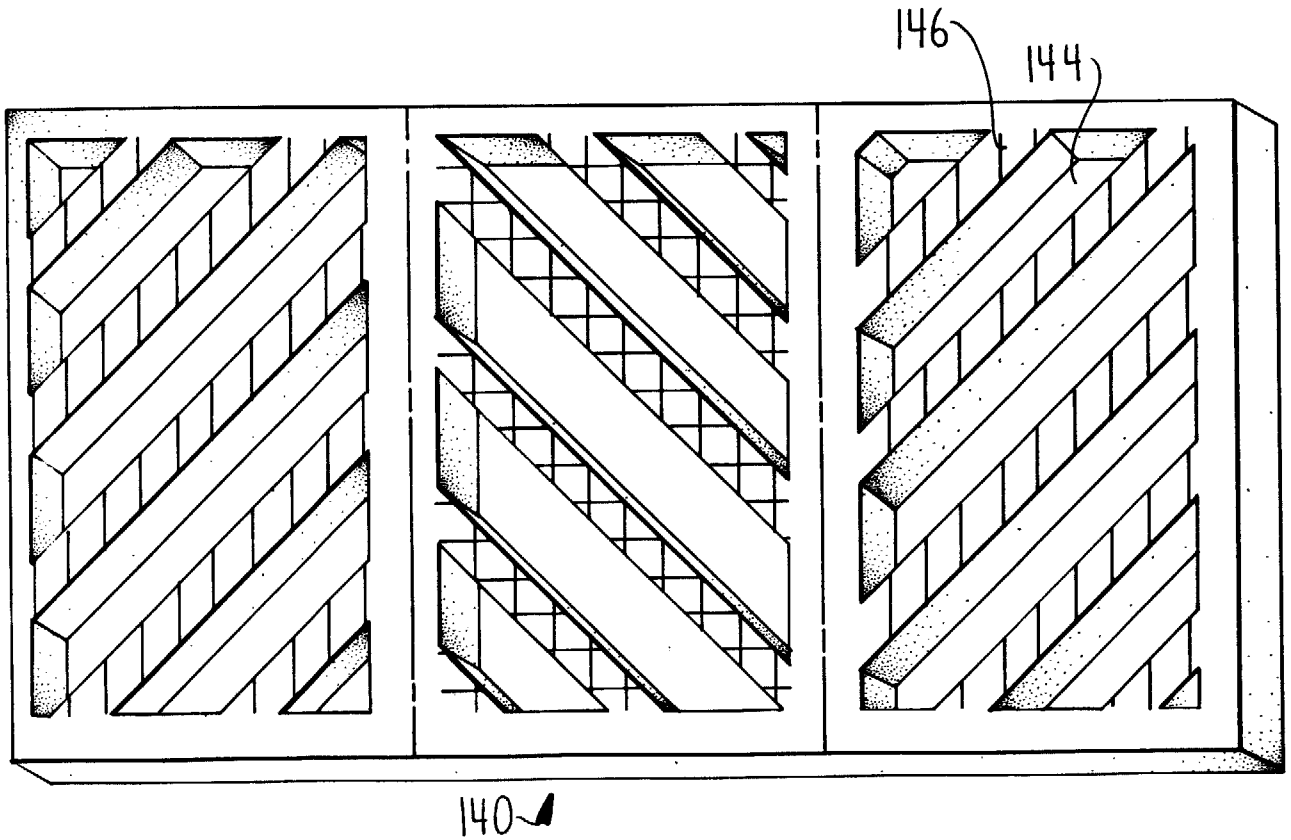
FIG. 14 is another embodiment of the instant invention.
Figure 15:
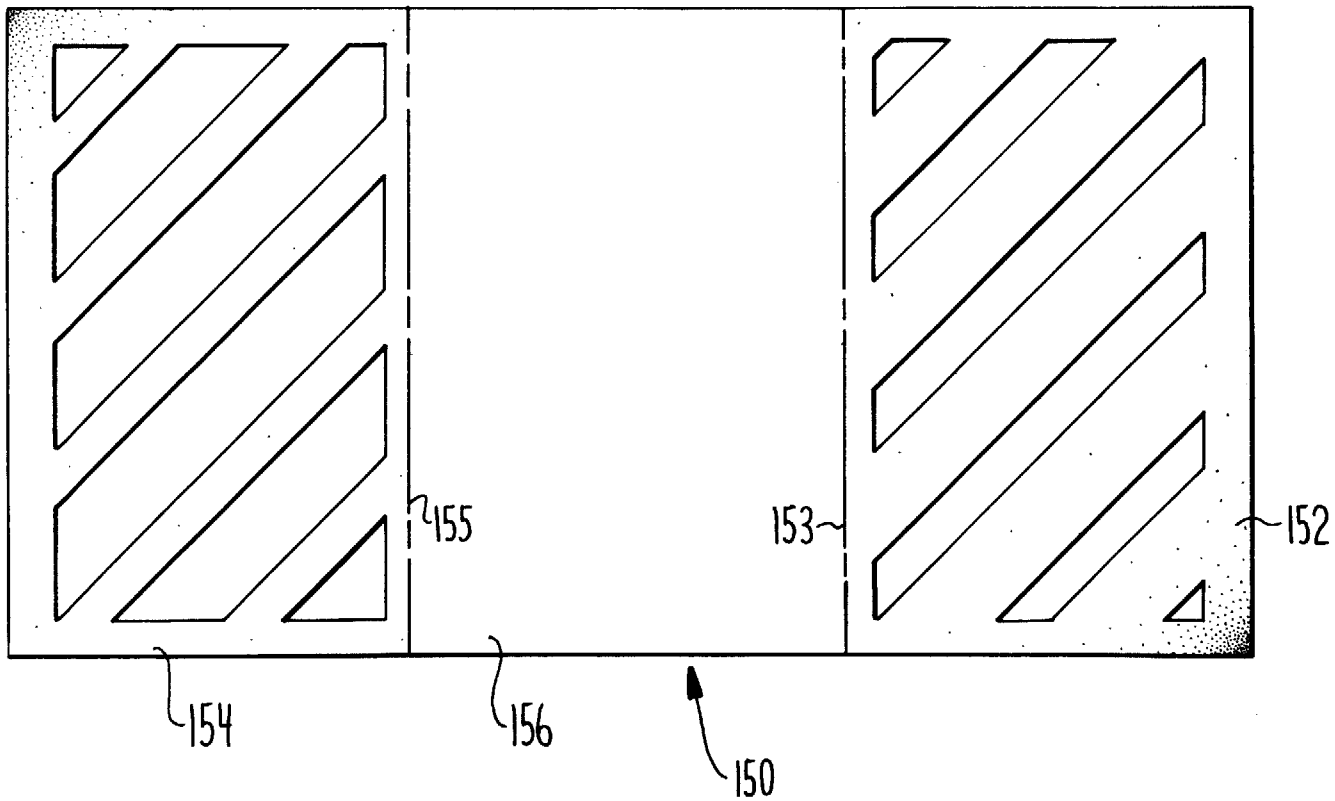
FIG. 15 is an additional embodiment of the instant invention.

As illustrated in FIG. 14, a card 140 can be used in which each panel employs two thirds window region 114 and one third illustration region 146. Similarly, one panel can have one third illustration region, but no window area, one panel can have one third illustration region and one third window region and the third panel can have one third illustration region and two thirds window region. In this embodiment, as illustrated in FIG. 15, the first side overlay 152 must first be folded, at fold line 153, over the central panel 156, and then the second side panel must be folded, at fold line 155, over the central panel. Since only one third the surface of the side panel 152 will be visible under the other side panel 154, the non-viewable region can be blank or can contain confusion producing or obfuscating graphics inorder to further increase the difficulty of anticipating the full illustration from the one third illustration segment on the side panel 152.

It should be understood that other variations and combinations can be employed within the scope of the invention. For example, the order of the panels can be altered, provided the folding arrangement is suitably altered. Thus, the central panel 156 can overlie the side panel 154, and the other side panel 152 can overlie the central panel 156, through the use of a "Z" configuration fold.

Figure 16:
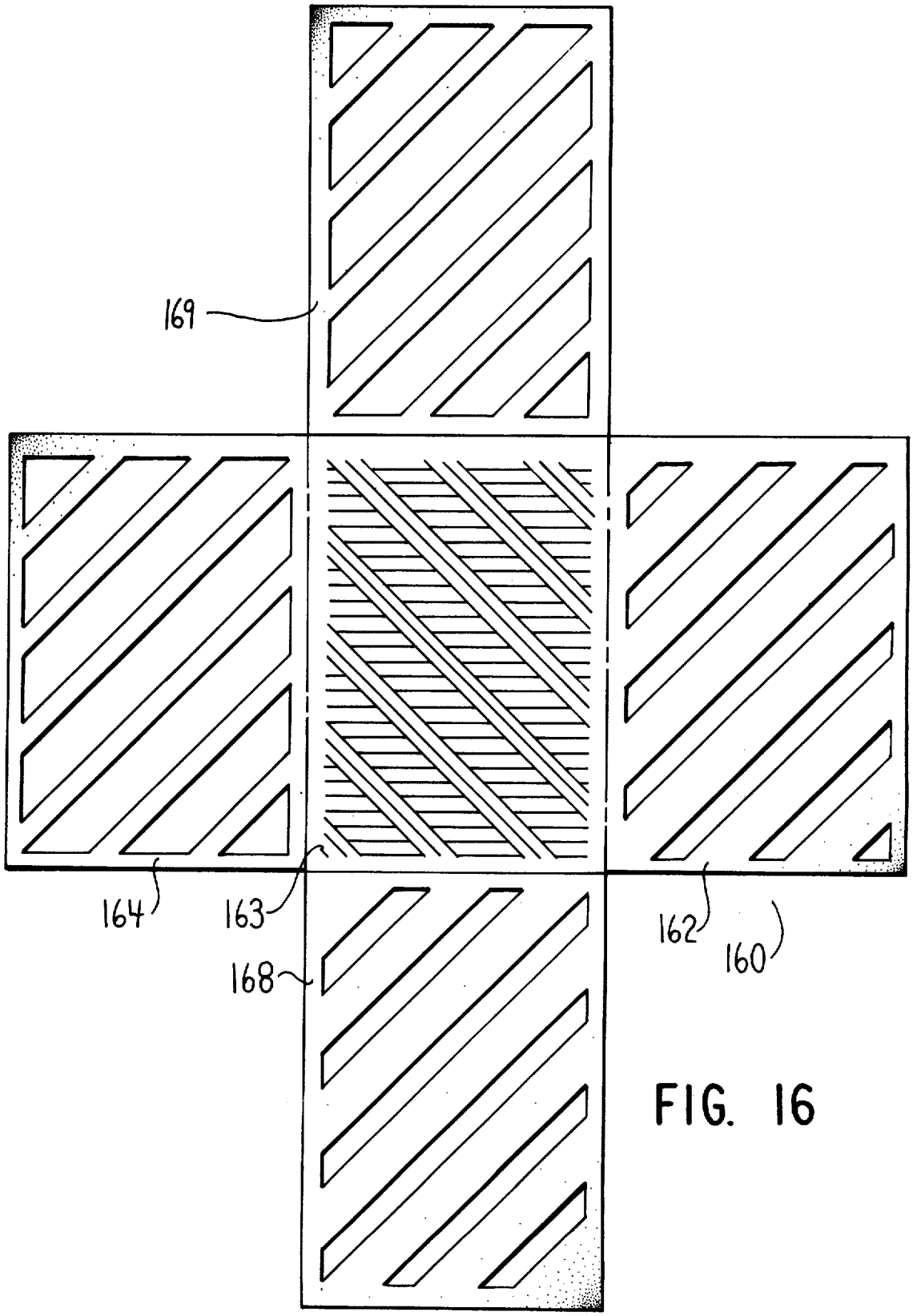
FIG. 16 is an embodiment of the instant invention utilizing five panels.

Also, additional side panels can be employed as illustrated in FIG. 16. The card as illustrated, employs a pair of side panels 162 and 164 which correspond to panels 152 and 154 of card 150 of FIG. 15. An additional pair of end panels 165 and 169 correspond functionally to the side panels 12 and 14 of the card 10 of FIG. 2.

In this embodiment as illustrated, the center panel 163 cooperates with one end panel 168 or 169 to produce a complete illustration. Each end panel 168 and 169 contains two thirds of an illustration, therefore producing two illustrations each having a low level of obfuscation. One third illustration segments in the manner of the side panels 162 and 164 could also be employed, as can other fractional combinations, depending upon the desired end result.

A puzzle effect can be achieved by using a window pattern and illustration segment combination which requires all four panels to be overlaid on the center panel in a particular sequence to produce the desired end result or a plurality of end results.

What is claimed is:

1. A novelty or educational device comprising in combination:

(a) a first panel, said first panel having a first group of illustration segments in a predetermined pattern, (b) at least one overlay panel contiguous with said first panel and separated therefrom by a fold line, said overlay panel having a plurality of window areas arranged in a pattern corresponding to said predetermined pattern, and a second group of illustration segments on non-window areas, said second group of illustration segments being the complement of said first group of illustration segments, and wherein said window areas being in a complex pattern alternating from window to solid area in both the horizontal and vertical directions whereby the illustrations of said illustration segments are obfuscated, and wherein both the reverse and the obverse of each panel contains illustrations segments which are the compliment of illustration segments of other panels, thereby providing at least a second illustration.

2. A novelty or educational device comprising in combination:

(a) a first panel, said first panel having a first group of illustration segments in a predetermined pattern, (b) at least one overlay panel contiguous with said first panel and separated therefrom by a fold line, said overlay panel having a plurality of window areas arranged in a pattern corresponding to said predetermined pattern, and a second group of illustration segments on non-window areas, said second group of illustration segments being the complement of said first group of illustration segments, and wherein said window areas are in a complex pattern alternating from window to solid area in both the horizontal and vertical directions whereby the illustrations of said illustration segments are obfuscated, and wherein said window areas are elongated openings having their primary axes at an angle in the range of from about 30 degrees to 60 degrees with respect to the edges of said panels.

3. The device of claim 1, further comprising a second overlay panel contiguous with one of said at least one overlay and said first panel, and having a plurality of window areas arranged in a pattern corresponding to said predetermined pattern of said illustrated segments of said first panel and said second group of illustration segments of said at least one overlay, and having illustration segments in non-window areas, said at least one overlay and said second overlay panel in combination with said first panel providing a complete illustration.

4. The device of claim 3, wherein said first overlay panel contains window areas and solid areas in a pattern which is the reverse of the window areas and solid areas pattern of said second overlay panel and wherein both the reverse and the obverse of each panel contains illustrations segments which are the complement of illustration segments of two other panels.

5. The device of claim 1, wherein said windows are in a non-uniform geometric pattern which is non-uniform in both the horizontal and vertical directions.

6. The device of claim 1, wherein said at least one overlay panel comprises at least a first overlay panel and a second overlay panel, each of said first panel and each of said first overlay panel and a second overlay panel having no more than about one third of the total illustration and complement each other in an overlay configuration to provide a complete illustration whereby said first overlay panel and said second overlay panel in combination with said first panel provide a first complete illustration when said first overlay panel overlays said first panel and a second complete illustration when said second when said first overlay panel overlays both said first overlay panel and said first panel and wherein both the reverse and the obverse of each panel contains illustrations segments which are the complement of illustration segments of two other panels, thereby providing at least a third and a fourth illustration.

7. The device of claim 1, wherein two overlay panels are contiguous with said first panel, one of said overlay panels having illustration segments comprising about half of an illustration, said first panel having the complementary half of said illustration intermixed with about half of a second illustration complementary with the illustration on the other of said panel.

8. The device of claim 1 comprising a second overlay panel contiguous with and substantially coextensive with said first panel, a third overlay panel contiguous with and substantially coextensive with said first panel and a fourth overlay panel contiguous with and substantially coextensive with said first panel, each of the overlay panels sharing a fold line with said first panel.

9. The device of claim 1, wherein said predetermined pattern contains windows having peripheral edges which are in the form of an arc of a circle.

10. The device of claim 9, wherein said predetermined pattern contains windows having peripheral edges which are arcs of concentric circles.

11. The device of claim 10, wherein said predetermined pattern contains a plurality of windows having peripheral edges which are arcs of non-concentric circles.

12. The device of claim 1, wherein said predetermined pattern contains at least horizontal or vertical bands in which the pattern alternates from window and solid areas on the order of about four times in an inch.

13. The device of claim 12, wherein said pattern contains both horizontal and vertical bands in which the pattern alternates from a window area to a solid area on the order of about four times in an inch.

14. The device of claim 1, wherein said predetermined pattern is in the form of alternating window and solid areas, the alternating occuring on the order of about four times every inch, in substantially every horizontal band having a vertical width on the order of about one quarter of an inch.

15. The device of claim 1, wherein said predetermined pattern is in the form of alternating window and solid areas, the alternating occuring on the order of about four times every inch, in substantially every vertical band having a horizontal width on the order of about one quarter of an inch.

* * * * *